US005729806A

United States Patent [19]

Niwano et al.

[11] Patent Number: 5,729,806

[45] Date of Patent: Mar. 17, 1998

[54] CURVED DEVELOPER AMOUNT CONTROLLING MEMBER, DEVELOPING APPARATUS, AND PROCESS CARTRIDGE USING THE SAME

[75] Inventors: Kentaro Niwano, Yamato; Masahiro Watabe, Yokohama; Arihiro Yamamoto, Tokyo, all of Japan

[73] Assignee: Canon Kabushiki Kaisha, Tokyo, Japan

[21] Appl. No.: 655,147

[22] Filed: May 30, 1996

[30] Foreign Application Priority Data

May 31, 1995 [JP] Japan ..... 7-155512

[51] Int. Cl.[6] ..... G03G 15/08

[52] U.S. Cl. ..... 399/284; 399/274

[58] Field of Search ..... 399/274, 284; 355/245

[56] References Cited

U.S. PATENT DOCUMENTS 4,975,746 12/1990 Miyauchi et al. ..... 355/245

5,485,254 1/1996 Bogoshian et al. ..... 355/253

5,587,551 12/1996 Ikegawa et al. ..... 399/284

FOREIGN PATENT DOCUMENTS 6-258926 9/1994 Japan .

6-258934 9/1994 Japan .

*Primary Examiner*—Joan H. Pendegrass

*Assistant Examiner*—Quana Grainger

*Attorney, Agent, or Firm*—Fitzpatrick, Cella, Harper & Scinto

[57] ABSTRACT

A developer amount controlling member which has a support layer for controlling pressure and an elastic layer for controlling triboelectricity provided thereon, wherein both end portions of the developer amount controlling member are curved from the central portion thereof towards the elastic layer side.

5 Claims, 3 Drawing Sheets

CURVED DEVELOPER AMOUNT CONTROLLING MEMBER, DEVELOPING APPARATUS, AND PROCESS CARTRIDGE USING THE SAME

BACKGROUND OF THE INVENTION

1. Field of the Invention

The present invention relates to a developing apparatus for developing and visualizing electrostatic latent images formed on an image-holding member, and more specifically to a developer amount controlling member used in a developing apparatus for developing images with a single component developer containing no carriers.

2. Related Background Art

FIG. 1 is a diagram schematically showing the constitution of a developing apparatus. As FIG. 1 shows, a single-component developer 6 (hereafter called a toner) is carried on a developer-carrying member 3 (hereafter called a developing sleeve) rotating in the direction of the arrow b to the developing area where electrostatic latent images are developed, and a rubber or metal member 4 for controlling the amount of the developer (hereafter called a developer doctor blade) is in contact with the developing sleeve 3, where the amount of the toner 6 is controlled by passing through the nip of the developer doctor blade 4 and the developing sleeve 3, forming a thin film of the toner 6 on the developing sleeve 3, at the same time the toner 6 is triboelectrified at the contact point for developing latent images.

Here, the developer doctor blade must be made from an elastic material, since the developer doctor blade 4 is in contact with the developing sleeve 3 in a manner that the blade 4 is urged in the counter direction of the rotating direction of the sleeve 3. That is, the free edge of the blade 4 is in contact with the sleeve 3 upstream of the rotating direction b compared with the other edge fixed to the developing vessel 2.

Conventionally, elastic rubber is often used for the developer doctor blade. However, when such a blade is used for a long period of time, the elastic material changes by aging (plastic deformation) causing a problem in durability.

Therefore, it was proposed in Japanese Patent Application Laid-Open No. 6-258926 to use a developer doctor blade composed of two or more layers. An elastic layer **4*b* for controls the amount of electrostatic charge of the developer, and a support layer 4*a* in contact with the elastic layer 4*b*** for controls pressure.

In the electrophotographic process for A-3 size copying, a long and thin developing blade corresponding to the wide developing area is required, since an A-3 sheet is about as wide as 306.5 mm. When a developer doctor blade composed of an elastic layer and a rigid layer is used for development of such a wide area, the pressure for uniformly applying the toner to the entire developing area tends to become uneven.

Especially a both end portions (lower corners) of the developer doctor member, it is very difficult to press the developer doctor blade against the toner on the sleeve with a constant pressure. This is because the pressure to press the toner on to the sleeve is lowered at the both end portions of the blade in comparison with the pressure at the central portion due to accumulation or leakage of the toner.

This low pressure state due to the release of pressure at the both end portions of the developer doctor blade increases the toner thickness at the edge areas of the sleeve, often resulting in the improper image density or fogging images. One of the most important factors in the developing process is considered to be effecting uniform toner thickness on the sleeve in the lengthwise direction. Conventionally, pressure lowering at the both end portions of the blade was prevented by installing a jig for the developer doctor blade and the like.

However, the conventional method has become inapplicable because light weight, compact size, and low cost are now required for the apparatus. The solution of the problem by the constitution of the developer doctor blade itself has been demanded.

Therefore, the constitution of the developer doctor blade, which can uniformly apply the toner on the entire developing area by itself, is required. In particular, a developer doctor blade which can apply the toner on the both end portions where toner leakage easily occurs, to the same extent as on the central portion of the developing area is required.

SUMMARY OF THE INVENTION

It is an object of the present invention to solve the above problem, and to provide a toner doctor blade which can form a uniform toner layer on the developing sleeve over the entire width of the developing sleeve, and particularly to provide a developer doctor blade which enables the uniform application of the toner at the both end portions where toner leakage tends to occur.

It is another object of the present invention to provide a developing apparatus using such a developer doctor blade.

The feature of the present invention is that a developer amount controlling member (a developer doctor blade) is comprised of a support layer for controlling the pressure and an elastic layer for controlling electrostatic charge provided thereon, and both end portions of the member are curved towards the elastic layer side.

According to the present invention, the developer doctor blade can apply pressure uniformly to the entire contact area of the developing sleeve with neither toner accumulation, toner leakage at the both end portions without a decrease in the amount of the toner at the both edge portions of the developing sleeve.

Accordingly, toner can be triboelectrified with constant pressure throughout the nip of the blade and the developing sleeve, and high-quality developing is achieved.

BRIF DESCRIPTION OF THE DRAWINGS

DETAILED DESCRIPTION OF THE PREFFERED EMBODIMENT

First, the present invention will be described referring to FIGS. 2 and 3.

Figure 2:
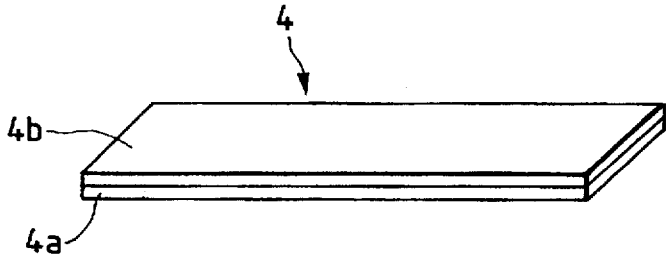
FIG. 2 PRIOR ART
FIG. 2 is a diagram showing a shape of a developer doctor blade according to prior art.

As shown in FIG. 2, the shape of the conventional developer doctor blade is flat. As shown in FIG. 3, the developer doctor blade 4 of the present invention has a double-layer constitution consisting of a support layer 4*a* for controlling pressure and an elastic layer 4*b* for controlling electrostatic charge, and the both end portions thereof are curved towards the elastic layer 4*b* side.

Here, the characteristics of the support layer and the elastic layer of the developer doctor blade will be described. The material of the support layer is preferably selected from materials having a bending modulus larger than the bending modulus of the elastic layer, because the support layer should have properties to prevent the blade from deforming with time due to the pressure which the elastic layer in contact with the developer applies to the developing sleeve.

The preferred materials used for the support layer include (1) a sheet of metal such as stainless steel, phosphor bronze and aluminum, of which the thickness is between 20 μm and 500 μm in order to control the contact force against the developing sleeve, and (2) a hard, springy elastic sheet of a plastic, such as polyethylene terephthalate, polycarbonate and oriented polypropylene, of 50 μm to 100 μm in thickness.

The preferred rubber materials for the elastic layer include elastic rubbers such as HTV rubber (high temperature curing type millable silicone rubber and the like), thermoplastic urethane rubber, liquid urethane rubber, liquid nitrylbutadiene rubber, liquid silicone rubber (LTV, RTV, etc.) and the modified products and the blend thereof. The thickness of the elastic layer is preferably in the range between 0.1 mm and 2.5 mm.

Next, the methods will be explained for forming the developer doctor blade of a double-layer constitution consisting of a support layer and an elastic layer, of which both end portions (in the lengthwise direction) are curved towards the elastic layer side.

These methods include a method in which the elastic layer is bonded to the support layer curved at the end portions using a double-faced adhesive tape or a hot melt adhesive, and a method in which a liquid primer, thermosetting primer or a paste-like adhesive is applied on the support layer, and the elastic layer is bonded on it using pressure and, if required, heat.

Another method is to mold a support layer and an elastic layer integrally in a hot-press mold. Japanese Patent Application Laid-Open No. 6-258926 discloses a method for forming a flat developer doctor blade. In the similar manner, but by modifying the shape inside the mold, a developer doctor blade can be formed such that both end portions are curved towards the elastic layer side.

Figure 4A:
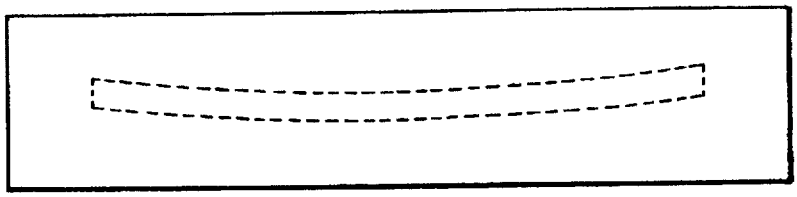
FIGS. 4B and 4C are diagrams showing the structures of molds for hot-press molding of the developer doctor blade.

An example of a method using a modified mold is to as follows: A mold is machined to have curved end portions as shown in FIG. 4A, then a support layer and an elastic material is placed in the mold in this order to thermally cure the elastic layer using heat and pressure in the closed mold, and at the same time to thermally bond the elastic layer to the support layer with a primer already applied on the support layer. (This method is effective when the elastic material has a high viscosity.)

Next, another hot-press molding method for the production of a developer doctor blade will be described. The both end portions of the developer doctor blade can be curved towards the elastic layer side by adjusting the temperature distribution in the mold so that the temperature $T_1$ at the both end portions is higher than the temperature $T_2$ at the central portion (FIG. 4B), even when a mold with a flat inner surface is used. By this method, the elastic layer at the central portion where the temperature is lower becomes thicker than at both end portions, and on cooling, the elastic layer shrinks from the both end portions towards the central portion resulting in the warping of the elastic layer.

Figure 4B:
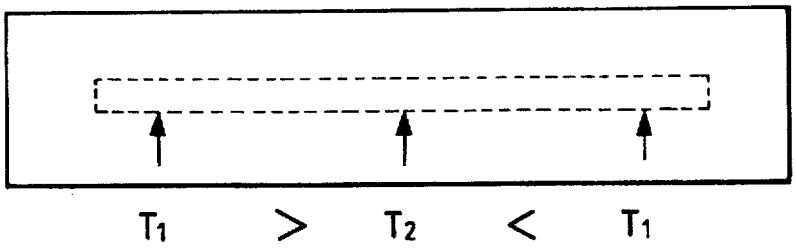
Figure 4C:
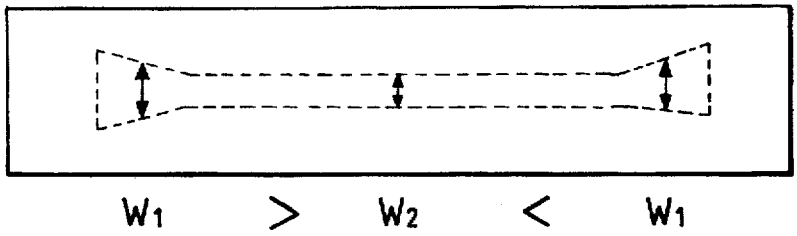

Another effective method is to make the elastic layer thicker at the both end portions of the developer doctor blade than at the central portion (FIG. 4C).

When integral forming in a hot-press mold is used, the molding conditions should be controlled carefully not to cause excess warping, because the warping of the elastic layer formed on the support layer becomes large if the elastic layer is too thick, or if the temperature in the mold is too high. If the warping of the developer doctor blade is excessive, the blade comes in contact with the developer on the developing sleeve at a high pressure, and the amount of the developer applied on the edge portions of the developing sleeve becomes smaller than the optimal amount. Therefore, the amount of the developer becomes insufficient at the both edge portions of the imaging area, lowering the image density corresponding to the solid black image at the both edge portions of the image area.

Next, production methods other than hot-press molding will be described. For example, these methods include injection molding and cast molding of the material for the elastic layer onto the support layer in a mold. Injection molding uses an injection molding machine. In a mold engraved so that the both end portions of the developer doctor blade are curved towards the elastic layer side, a support layer to which a primer is applied is placed and then the material for the elastic layer is injected into the mold. (This method is effective for both materials having a high viscosity and a low viscosity.) In these methods, an elastic layer of which row material is liquid is integrally molded in a sheet form on the surface of a support layer to which a primer has been applied. The mold used is constructed as in hot-press molding, i.e., the mold shape (FIG. 4A), temperature distribution (FIG. 4B) and blade thickness distribution (FIG. 4C), so that the both end portions of the developer doctor blade are curved towards the elastic layer side. The elastic layer may be secondarily vulcanized as required after molding, and finally, cut in desired shape and size. (When the viscosity of the material before processing is low, cast molding at a low pressure is more advantageous than injection molding in terms of production costs.)

Japanese Patent Application Laid-Open No. 6-258934 discloses a method for forming two layers of a curved sheet using a centrifugal molding machine. In this method, a support layer is placed in the centrifugal molding machine and an elastic layer is thermally cured and thermally bonded on the support layer while the drum is rotating. (This method is effective when the material for the elastic layer has a low viscosity.) After molding, the blade is cut into the desired length and width to fabricate the developer doctor blade of the present invention.

Still another method is to pour a material between two standing molds having surfaces curved at the both end portions of the elastic layer so that the both end portions of the developer doctor blade are curved towards the elastic layer side, then heat is applied to the elastic layer to cure and bond to the support layer (This method is effective only when the viscosity of the material for the elastic layer before processing is low.)

The developer doctor blade of the present invention is effective when it has not only two layers of the support layer and elastic layer, but other layers such as a surface coating of a desired triboelectrifying material.

Figure 5:
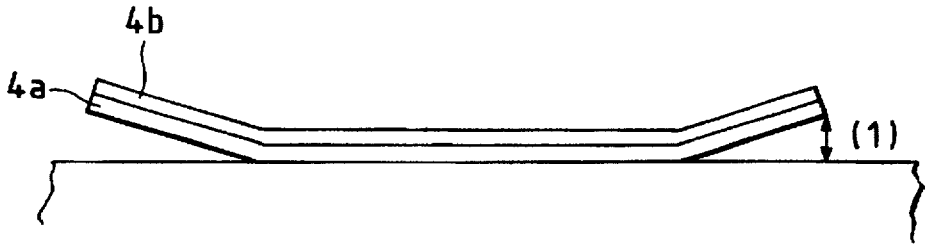
FIG. 5 is a diagrams illustrating a method of measuring the warping degree (height of each end of blade) of the developer doctor blade.
Figure 6:
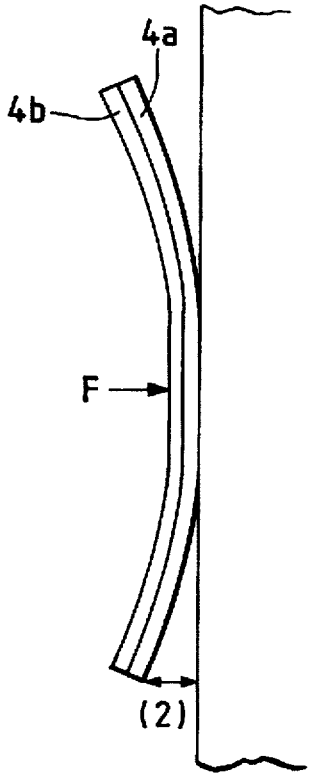
FIG. 6 is a diagrams illustrating another method of measuring the warping degree (height of each end of the blade) of the developer doctor blade.

It has also been known that the warping degree of the both end portions varies due to difference in the materials used for the elastic layer of the developer doctor blade. For example, in the case of a developer doctor blade having a length of 316 mm, a width of 16 mm, and a total thickness of 0.4 mm using a stainless steel (SUS 304H) for the support layer, when a silicone rubber is used for the elastic layer, the warping degree (height of each end) is 3 mm when measured on a level plate (FIG. 5), and 15 mm when measured in the vertical position with its central portion held (FIG. 6). On the other hand, when a polyurethane coated with 10 μm nylon is used for the elastic layer, the warping degree (height of each end) is 5 mm when measured on a level plate (FIG. 5), and 25 mm when measured in the vertical position with its central portion held (FIG. 6).

If the warping of the both end portions of the developer doctor blade (height of each end) exceeds 50 mm, the image of electrophotography becomes poor. This is because the pressure on to the developer on the developer carrying member becomes too high, and the amount of the developer at the both end portions becomes too small, lowering the density at the both side portions of the image.

When the developer doctor blade is placed on a level plate with the support layer down, the warping degree of the both end portions (height of each end) is preferably 50 mm or less, and more preferably 35 mm or less. The height of each end is normally 5 mm or more, and preferably 10 mm or more.

The length of the developer doctor blade is preferably between 200 mm and 316 mm when A-4 and A-3 sizes of copies are considered.

Figure 1:
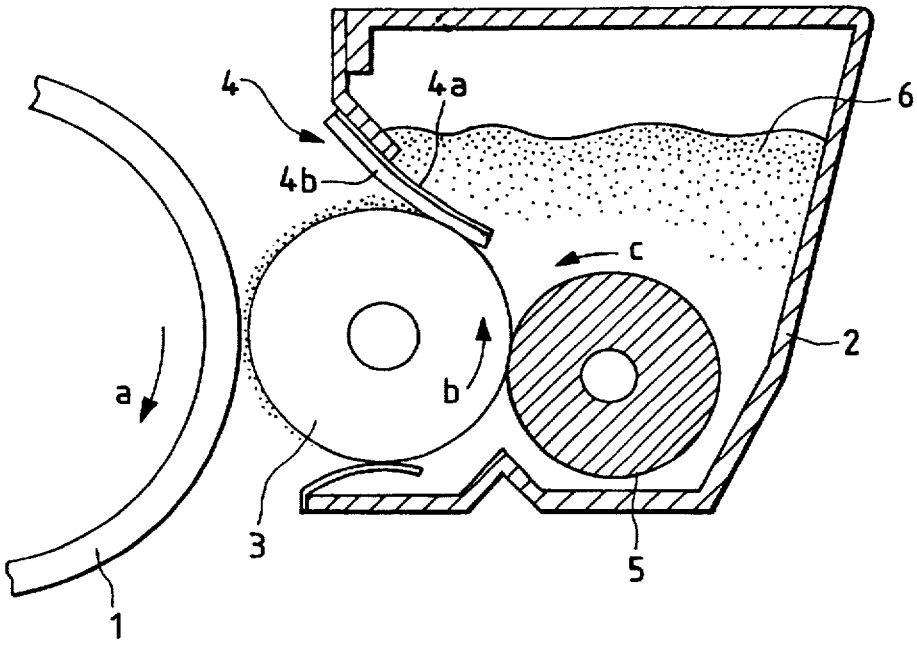
FIG. 1 is a schematic sectional view showing the constitution of a developing apparatus.

Referring to FIG. 1, an imaging apparatus using the elastic blade of the present invention will be described.

In FIG. 1, a developing vessel 2 contains a toner 6. The developing apparatus comprises a photosensitive drum 1 which is the image carrying member rotating in the direction of the arrow a, and a developing sleeve 3 as the toner carrying member facing to the photosensitive drum 1 in the developing vessel 2, to develop and visualize an electrostatic latent image on the drum 1 as a toner image. The developing sleeve 3 is horizontally and rotatably installed so that the right half circumference viewed in the diagram of the developing sleeve 3 is inserted into the developing vessel 2, and the left half circumference thereof is exposed out of the developing vessel 2 to face to the photosensitive drum 1. A minute gap is provided between the developing sleeve 3 and the photosensitive drum 1. The developing sleeve 3 is rotatably driven in the direction of the arrow b where the photosensitive drum 1 is rotated in the direction of the arrow a.

In the developing vessel 2, an elastic blade 4 of the present invention is also installed in the position above the developing sleeve 3, and an elastic roller 5 is installed in the position upstream of the rotation direction of the developing sleeve 3 compared with the elastic blade 4.

The elastic blade 4 is slantingly and downwardly installed in the upstream position of the rotating direction of the developing sleeve 3, and is in contact with the upper circumferential surface of the developing sleeve 3 against the rotating direction thereof.

The elastic roller 5 is provided in contact with the developing sleeve on the opposite side to the photosensitive drum 1, and is rotatably held.

In the operation of the developing apparatus, the elastic roller rotates in the direction of the arrow c, the toner 6 is carried by the elastic roller 5 and fed in the vicinity of the developing sleeve 3, and at the nip where the developing sleeve comes in contact with the elastic roller 5, the toner 6 on the elastic roller 5 is transferred onto the developing sleeve 3 by being rubbed with the developing sleeve 3.

Then, the toner 6 transferred onto the developing sleeve 3 enters into the nip between the elastic blade 4 and the developing sleeve 3 when the developing sleeve 3 rotates, and is electrostatically charged sufficiently by the friction between the surface of the developing sleeve 3 and the elastic blade 4.

The toner 6 thus charged comes out of the nip between the elastic blade 4 and the developing sleeve 3, forming a thin layer of the toner 6 on the developing sleeve 3, and is conveyed to the developing zone where the photosensitive drum 1 and the developing sleeve 3 face each other with a minute gap. In the developing zone, with application of, for example, an alternate voltage comprised of a direct current superposed to an alternate current as a developing bias, the toner 6 on the developing sleeve 3 is transferred onto the electrostatic latent image on the photosensitive drum to form a developed toner image.

The toner 6 which has not been consumed for developing in the developing zone and remained on the developing sleeve 3 is recovered at the lower portion of the developing sleeve into the developing vessel 2 as the developing sleeve 3 rotates.

The toner 6 is scraped out of the developing sleeve 3 by the elastic roller 5 at the contact portion with the developing sleeve 3. At the same time, a new toner 6 is fed on to the developing sleeve 3 by the rotation of the elastic roller 5, and is conveyed to the nip between the elastic blade 4 and the developing sleeve 3.

Most of the toner 6 scraped from the developing sleeve 3 is conveyed and mixed into the toner 6 in the developing vessel 2 as the elastic roller 5 rotates, where the electrostatic charge of the recovered toner 6 is dispersed.

The toner used is a magnetic toner or a non-magnetic color toner and the like, and the average particle size is preferably between 2 μm and 15 μm.

According to the present invention, the elastic layer of the developer doctor blade can provide predetermined charge amount to the developer for a long period of time without plastic deformation, since the elastic layer is provided on a support layer which controls the contact force to the developing sleeve through the developer. In addition, by constructing the developer doctor member to have the both end portions curved towards the elastic layer side, pressure to the developing sleeve is controlled to be uniform even at the both end portions of the developer doctor blade where the pressure tends to be reduced. Thus, the one-component developer can be distributed evenly on the developer sleeve, solving the problem of low image density near the both side edges.

Figure 7:
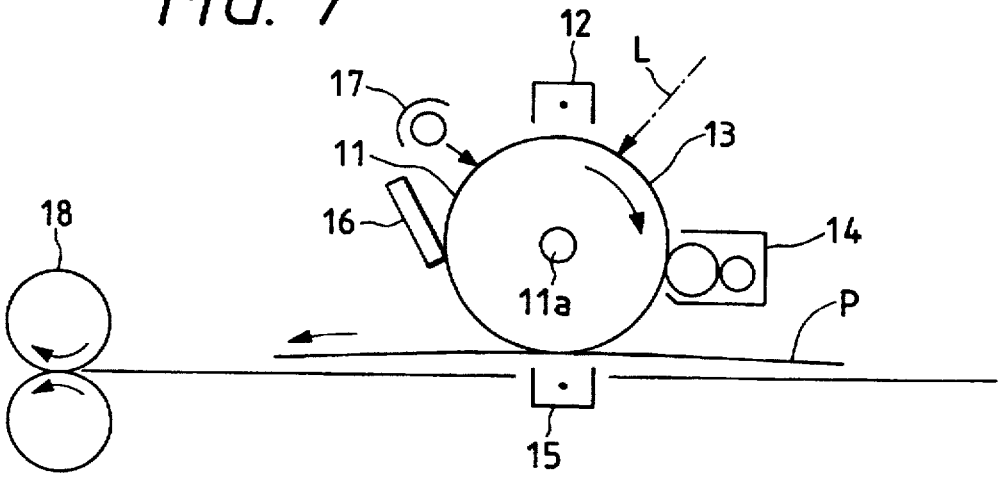
FIG. 7 is a schematic diagram showing the constitution of an embodiment of electrophotographic apparatus employing the developing apparatus of the present invention.

FIG. 7 shows an example of the electrophotographic apparatus suited for the developing apparatus of the present invention.

In FIG. 7, the symbol 11 indicates a photosensitive member to be charged, and in this example, it is a drum-type electrophotographic photosensitive member comprised of an electroconductive support such as aluminum and a photosensitive layer formed on the outer surface of the support. It is rotatably driven clockwise viewed in the diagram around the axis at a desired peripheral speed.

The charging member 12 is a corona discharger in contact with the surface of the photosensitive member 11 to primarily charge the surface of the photosensitive member evenly with a desired polarity and potential.

The surface of the photosensitive member 11 charged by the charging member 12 is then subjected to image wise exposure by an exposing means n (laser beam scanning, the slit exposure of the original image, etc.), and an electrostatic latent image 13 corresponding to the image information is formed on the circumference.

The latent image is sequentially visualized as a toner image by the developing apparatus 14.

This toner image is then transferred sequentially to the receiving material P fed from the paper feeder means (not shown) and conveyed to the transferring zone between the photosensitive member 11 and the transfer means 15 with a timing synchronized with the rotation of the photosensitive member 11. The transfer means 15 of this example is a corona discharger, and the toner image on the surface of the photosensitive member 11 is transferred on the front surface of the receiving material P by charging the receiving material from the back face to the opposite polarity.

The receiving material P on which the toner images have been transferred is separated from the surface of the photosensitive member 11, sent to the heat fixing roller 18 where the toner images are fixed, and output as the finished product.

The photosensitive member 11 after the image has been transferred is cleaned to remove the contaminants such as remaining toner using the cleaning means 16, and used repeatedly for subsequent operations.

A plurality of elements for electrophotographic equipment such as the photosensitive member, the charging member, the developing apparatus and the cleaning means may be incorporated integrally into a process cartridge. The process cartridge can be made detachable from the main part of the apparatus. For example, a photosensitive member and a developing apparatus, and if required, a charging member and a cleaning means can be incorporated integrally into a process cartridge, and attached to and detached from the main part of the equipment using a guide means such as rails installed on the main part of the apparatus.

Electrophotographic apparatus which can use the developing apparatus of the present invention include copying machines, laser beam printers, LED printers, and applied electrophotographic equipments such as electrophotographic plate making systems.

EXAMPLE 1

Example 1 of the present invention will be explained referring to FIG. 3.

Figure 3:
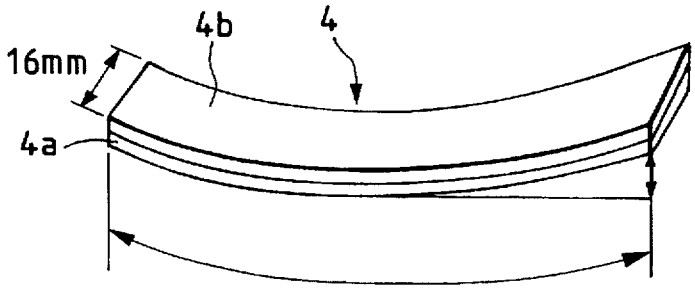
FIG. 3 is a diagram showing the shape of a developer doctor blade according to an embodiment of the present invention.

To a stainless-steel foil (SUS 304CSP-H) of a thickness of 0.06 mm as a support layer **4*a* in FIG. 3, a primer for silicone rubber is applied. The support layer is placed in a mold which has been worked so that the both end portions of the produced developer doctor blade are curved towards the elastic layer side as shown in FIG. 4A and has a mirror-polished surface. Then high temperature curing LTV silicone rubber (Toray-Dow Corning, liquid silicone rubber (LSR) DY35-7002) is injected in the mold using a injection molding machine for rubber (Matsuda Seisakusho), and is held in the mold for 5 minutes at 120° C., to form a silicone rubber elastic layer 4*b* having a thickness of 0.4 mm on the stainless-steel foil. The elastic layer is secondarily vulcanized at 200° C. for 4 hours. The vulcanized elastic layer is then cooled and cut to the shape shown in FIG. 3** using a cutter (Super Cutter manufactured by Hagino Seiki) to form a developer doctor blade.

EXAMPLE 2

To a stainless-steel foil (SUS 304CSP-H) of a thickness of 0.06 mm as a support layer **4*a* in FIG. 3, a primer for silicone rubber is applied. The support layer is placed in a mold which has been worked so that the both end portions of the produced developer doctor blade are curved towards the elastic layer side as shown in FIG. 4A and has a mirror-polished surface. In addition, as shown in FIG. 4B, the mold temperature corresponding to the both end portions of the blade is set at a higher temperature. Then high temperature curing LTV silicone rubber (Toray-Dow Corning, liquid silicone rubber (LSR) DY35-7002) is injected in the mold using a injection molding machine for rubber (Matsuda Seisakusho), and is held in the mold for 5 minutes at 120° C., to form a silicone rubber elastic layer 4*b* having a thickness of 0.4 mm on the stainless-steel foil. The elastic layer is secondarily vulcanized at 200° C. for 4 hours. The vulcanized elastic layer is then cooled and cut to the shape shown in FIG. 3** using a cutter (Super Cutter manufactured by Hagino Seiki) to form a developer doctor blade.

EXAMPLE 3

To a stainless-steel foil (SUS 304CSP-H) of a thickness of 0.06 mm as a support layer **4*a* in FIG. 3, a primer for silicone rubber is applied. The support layer is placed in a mold which has been worked so that the both end portions of the produced developer doctor blade are curved towards the elastic layer side as shown in FIG. 4A and has a mirror-polished surface. In addition, as shown in FIG. 4B, the mold temperature corresponding to the both end portions of the blade is set at a higher temperature, and further the mold has been modified to make the elastic layer thicker at the both end portions as shown in FIG. 4C. Then high temperature curing LTV silicone rubber (Toray-Dow Corning, liquid silicone rubber (LSR) DY35-7002) is injected in the mold using a injection molding machine for rubber (Matsuda Seisakusho), and is held in the mold for 5 minutes at 120° C., to form a silicone rubber elastic layer 4*b* having a thickness of 0.4 mm on the stainless-steel foil. The elastic layer is secondarily vulcanized at 200° C. for 4 hours. The vulcanized elastic layer is then cooled and cut to the shape shown in FIG. 3** using a cutter (Super Cutter manufactured by Hagino Seiki) to form a developer doctor blade.

<Comparative Example 1>

A silicone rubber sheet having a thickness of 0.4 mm is formed by injection molding into a mold, and is bonded on a stainless-steel foil of a thickness of 0.06 mm using a double-faced adhesive tape. After bonding, the sheet is cut to form a developer doctor blade as shown FIG. 2.

Developer doctor blades produced in Examples and Comparative Example were installed in a copying machine (modified Canon NP 1215), and the formed images were evaluated. The results are shown in Table 1. Image density irregularity and white streaks were evaluated after the durability test for 10,000 sheets.

As the results show, fogging occurred in the image at both side portions in Comparative Example 1, and although the result of Example 3 was better than the results of Comparative Example 1, the image density at the both side portions was low, and the image output was inferior to that of Examples 1 and 2. The difference in the results between the Examples and the Comparative Example became large after the durability test.

TABLE 1

| | Example 1 | Example 2 | Example 3 | Comparative Example |
|---|---|---|---|---|
| Bonding method | Integral heat bonding | Integral heat bonding | Integral heat bonding | Double-face adhesive tape |
| Warping (height of each end) | 25 mm | 45 mm | 55 mm | 0 |
| Difference in blade pressure at both end portions and central portion | Very small | Small | Medium | Large |
| Image density irregularity* | A | A | B | C |
| White streak phenomenon** | A | B | B | C |

*Image density irregularity: Evaluated by the whiteness of the image when a solid-black image is output
**White streak phenomenon: Evaluated by the occurrence of white streaks when a solid-black image is output
A: No irregularity, no white streaks
B: Slight irregularity, a small number of white streaks
C: Significant irregularity, a large number of white streaks at the both sides of image

What is claimed is:

1. A developer amount controlling member comprising a support layer for controlling pressure and an elastic layer for controlling triboelectricity provided thereon, wherein both end portions of said developer amount controlling member are curved from the central portion thereof towards said elastic layer side; and wherein both end portions are curved with a height of each end of 5 to 50 mm when measured on a level plate with said support layer down.

2. A developer amount controlling member according to claim 1, of which end portions are curved with a height of each end of 10 to 50 mm when measured on a level plate with said support layer down.

3. A developing apparatus comprising a developer containing member for holding a developer, a developer carrying member for carrying and conveying said developer from said developer containing member to the developing zone, and a developer amount controlling member for controlling the amount of said developer applied to said developer carrying member, wherein said developer amount controlling member comprises a support layer for controlling pressure, and an elastic layer for controlling triboelectricity provided on said support layer, wherein both end portions of said developer amount controlling member are curved from the central portion towards said elastic layer side, and wherein both end portions are curved with a height of each end of 5 to 50 mm when measured on a level plate with said support layer down.

4. A developing apparatus according to claim 3, wherein said developer is a single-component developer.

5. A process cartridge integrally comprising at least an electrophotographic photosensitive member and a developing apparatus, and being attachable to and detachable from the main body of an image formation apparatus, wherein said developing apparatus comprises a developer containing member for holding a developer, a developer carrying member for carrying and conveying said developer from said developer containing member to the developing zone, and a developer amount controlling member for controlling the amount of said developer applied to said developer carrying member, wherein said developer amount controlling member comprises a support layer for controlling pressure, and an elastic layer for controlling triboelectricity provided on said support layer, wherein the both end portions of said developer amount controlling member are curved from the central portion towards said elastic layer side, and wherein both end portions are curved with a height of each end of 5 to 50 mm when measured on a level plate with said support layer down.

* * * * *

UNITED STATES PATENT AND TRADEMARK OFFICE

CERTIFICATE OF CORRECTION

PATENT NO. : 5,729,806

DATED : March 17, 1998

INVENTOR(S) : NIWANO ET AL.

It is certified that error appears in the above-identified patent and that said Letters Patent is hereby corrected as shown below:

Column 1

Line 45, "for" should be deleted.
Line 47, "for" should be deleted.
Line 58, "a both" should read --at both--.

Column 2

Line 56, "FIGS. 4B" should read --FIGS. 4A, 4B--.
Line 59, "diagrams" should read --diagram--.
Line 62, "diagrams" should read --diagram--.

Column 4

Line 15, "not" should read --so as not--.

Column 5

Line 25, "on to" should read --onto---.

Column 7

Line 10, "image wise" should read --imagewise--.

UNITED STATES PATENT AND TRADEMARK OFFICE

CERTIFICATE OF CORRECTION

PATENT NO. : 5,729,806

DATED : March 17, 1998

INVENTOR(S) : NIWANO ET AL.

It is certified that error appears in the above-identified patent and that said Letters Patent is hereby corrected as shown below:

Column 8

Line 21, "a" should read --an--.
Line 45, "a" should read --an--.

Signed and Sealed this

Fifteenth Day of September, 1998

Bruce Lehman

*Attest:*

BRUCE LEHMAN

*Attesting Officer*

*Commissioner of Patents and Trademarks*